United States Patent [19]

Bratt et al.

[11] 4,195,613

[45] Apr. 1, 1980

[54] DOUBLE-ACTING FOUR-CYLINDER HOT GAS ENGINE

[75] Inventors: Jan C. Bratt, Malmö; Bengt-Ove M. Moodysson, Åkarp, both of Sweden

[73] Assignee: Kommanditbolaget United Stirling (Sweden) AB & Co., Malmö, Sweden

[21] Appl. No.: 896,589

[22] Filed: Apr. 14, 1978

[30] Foreign Application Priority Data

May 20, 1977 [GB] United Kingdom ..... 21424/77

[51] Int. Cl.[2] ..... F02B 75/06

[52] U.S. Cl. ..... 123/192 B; 123/52 A; 123/53 BA; 123/62

[58] Field of Search ..... 123/192 R, 192 B, 52 A, 123/53 AA, 53 BA, 61 R, 62, 63

[56] References Cited

U.S. PATENT DOCUMENTS

| | | | |
|---|---|---|---|
| 1,681,910 | 8/1928 | Slaght | 123/53 BA |
| 2,013,163 | 9/1935 | Meyer | 123/192 B |
| 2,051,204 | 8/1936 | Elwell | 123/62 |
| 2,117,700 | 5/1938 | Burkhardt | 123/53 BA |
| 2,828,601 | 4/1958 | Meijer | 60/525 |
| 3,074,229 | 1/1963 | Baas et al. | 60/525 |
| 3,537,437 | 11/1970 | Paul et al. | 123/52 A |
| 3,563,223 | 2/1971 | Ishida | 123/192 B |
| 3,581,628 | 6/1971 | Williams | 123/192 B |

*Primary Examiner*—Charles J. Myhre
*Assistant Examiner*—Jeffrey L. Yates
*Attorney, Agent, or Firm*—Finnegan, Henderson, Farabow, Garrett & Dunner

[57] ABSTRACT

Hot gas engine units of the type having four parallel cylinders arranged in two parallel rows of two cylinders per row may be effectively balanced by a minimum of counterweight masses. The engine pistons are connected to two parallel crank shafts and four primary counterweights are positioned on the crankshafts each diametrically opposite a respective crank. The crankshafts engage a common gear wheel rotating opposite to but at the same angular speed as the two crank shafts, and the gear wheel is mounted on a third shaft parallel to the two crank shafts. Secondary counterweights including at least two axially spaced, oppositely directed secondary counterweights positioned on the third shaft are used to cancel the moment about the engine vertical axis produced by the primary counterweights.

7 Claims, 6 Drawing Figures

DOUBLE-ACTING FOUR-CYLINDER HOT GAS ENGINE

This invention relates to a double acting four-cylinder hot gas engine invention of the kind (herein called acting "the kind defined") in which the cylinders are all parallel with one another and there are two crank-shafts with axes parallel to one another, each crank-shaft being connected to two pistons reciprocating along axes which intersect the axes of the respective crank-shaft.

The present invention is intended to provide an engine of the kind defined which may be balanced effectively without numerous large counter-weight masses, with a view to obtaining an acceptable low total weight and good mechanical efficiency.

According to the present invention an engine of the kind defined is characterised in that for balancing purposes the engine is provided with a third shaft which is parallel to the two crank-shafts, gearing for driving the third shaft in rotation in synchronism with and in the opposite direction from the two crank-shafts, and carried by the third shaft there are at least two counter-weights which are spaced from one another in the axial direction of the third shaft and produce forces in directions which are diametrically opposite to one another with respect to the axis of the third shaft.

Preferably the said gearing comprises a gear wheel secured to the third shaft and carrying one of said counter-weights and meshing with two gear wheels secured one to each of the two crank-shafts.

In an advantageous and compact construction the third shaft is equi-spaced from the two crank-shafts and the distance between the third shaft and each of the cylinders is less than the smallest distance between each of the cylinders and the axes of the two crank-shafts.

Figure 1:
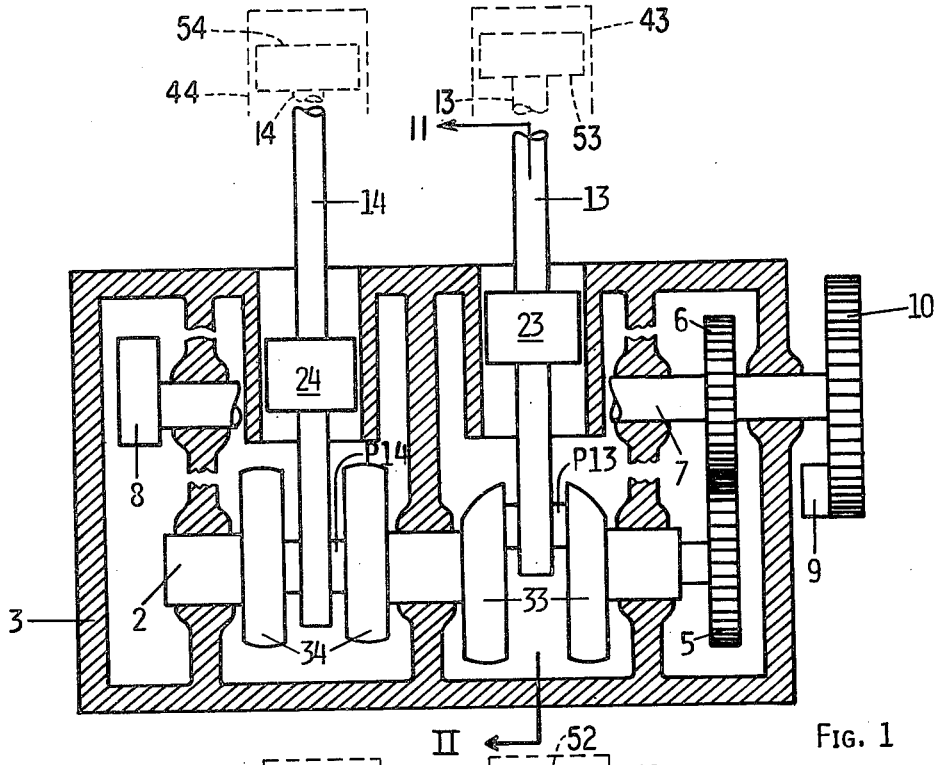
Figure 2:
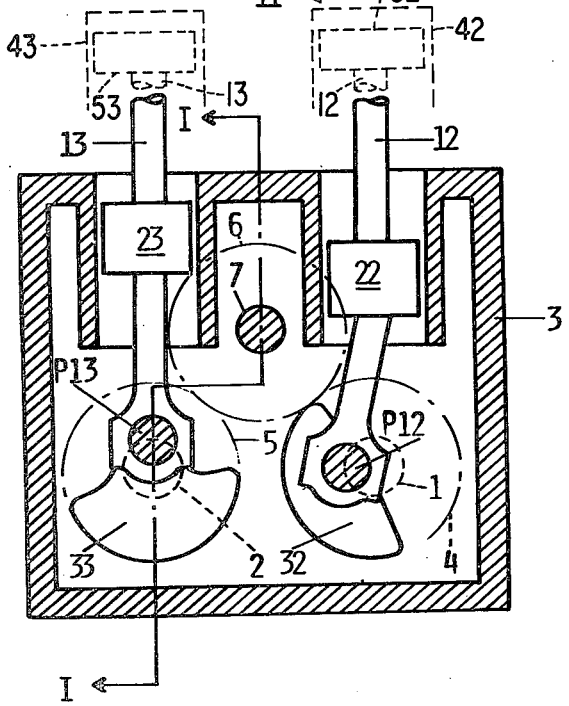
Figure 3:
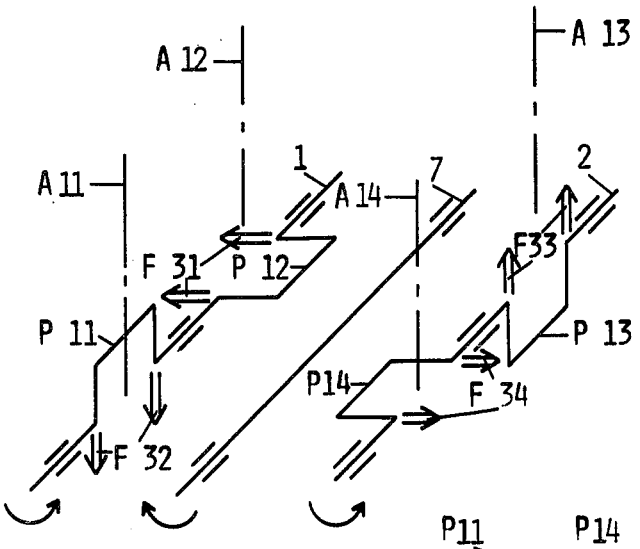
Figure 4:
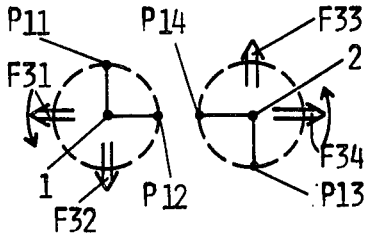
Figure 5:
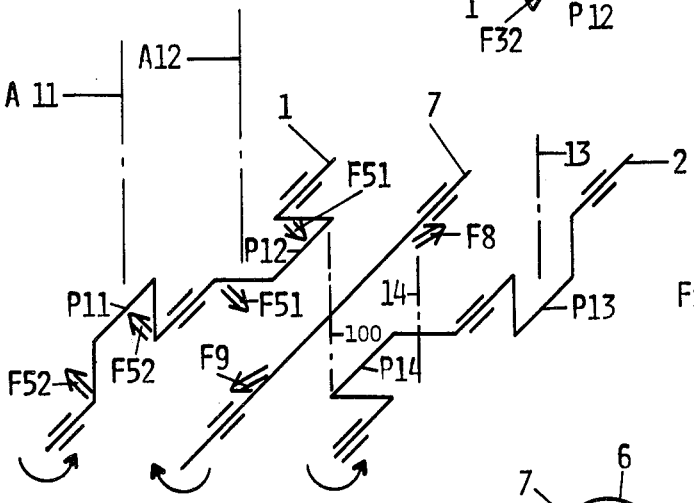
Figure 6:
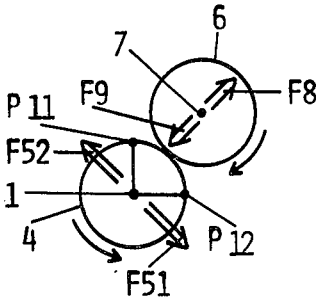

How the invention may be put into practice appears from the following description in more detail with reference to the accompanying drawings, in which FIG. 1 schematically shows a longitudinal section through parts of an engine according to the invention, the section being along the line I—I of FIG. 2, FIG. 2 is a section along the line II—II of FIG. 1, FIG. 3 is a perspective diagram illustrative of the primary balancing, FIG. 4 is an end view diagram illustrative of the primary balancing shown in FIG. 3, FIG. 5 is a perspective diagram illustrative of the secondary balancing, and FIG. 6 is an end view illustrative of the secondary balancing shown in FIG. 5.

As shown in FIGS. 1 and 2, the engine includes a mechanism comprising two crank-shafts 1 and 2 journalled in a crank-casing 3. The crank-shaft 1 is connected by connecting rods and cross-heads 22 to two piston rods 11 and 12 (of which only one cross-head 22 and the rod 12 are shown in FIG. 2). The crank-shaft 2 is connected by connecting rods and cross-heads 23 and 24 to two piston rods 13 and 14. The two crank-shafts 1 and 2 are provided with respective gear wheels 4 and 5 both meshing with a gear wheel 6 mounted on a third shaft 7 journalled in the casing 3 and extending parallel to the axes of the crank-shafts 1 and 2.

Three of the four engine cylinders, namely 42, 43, and 44 are shown schematically in FIGS. 1 and 2, together with associated respective pistons, namely 52, 53, and 54. Pistons 53 and 54 connect to crankshaft 2 through piston rods 13 and 14, and connecting rods and cross-heads 23 and 24, respectively. Piston 52 connects to crankshaft 1 through piston rod 12 and connecting rod and crosshead 22. As indicated previously, the four cylinders, including 42, 43, and 44, are parallel with one another, and the four pistons, including 52, 53, and 54, reciprocate along axes that intersect the axes of the respective crankshafts.

The third shaft 7 is provided with counter-weights 8 and 9 which produce forces F8 and F9 (FIGS. 5 and 6) in directions which are diametrically opposite to one another with respect to the axis of the third shaft 7. The counter-weights 8 and 9 are axially spaced along the shaft 7, the counter-weight 9 being mounted on a drive gear wheel 10. The crank-shafts 1 and 2 are provided with counter-weights of which one weight is not shown and the weights 32, 33 and 34 can be seen in FIGS. 1 and 2; these weights produce forces F31, F32, F33, F34 (FIGS. 3 and 4).

In FIGS. 3 to 6 the references signify as follows:

A11, A12, A13, A14— the vertical axes of the piston rods 11, 12, 13, 14

P11, P12, P13, P14— the four crank pins

F31, F32, F33, F34— forces produced by the said counter-weights on the webs of the crank-shafts

F51, F52— forces produced by further counter-weights on the crank-shaft 1

F8, F9— forces produced by the counter-weights 8 and 9 carried by the third shaft 7

100— the central vertical axis of the crank-shaft assembly.

FIGS. 3 to 6 represent the conditions at the moment when the crank pin P11 is at top dead centre, the crank pin P12 is rising, the crank pin P13 is at bottom dead centre, and the crank pin P14 is descending.

FIGS. 3 and 4 relate to the primary balancing of the engine, whereas FIGS. 5 and 6 relate to the secondary balancing.

The primary balancing is achieved by the counter-weights on the crank webs to produce the forces F31, F32, F33, F34, and these counter-weights necessary for the primary balancing should be chosen so that the total vertical forces of each piston are balanced. The relative angular positions of such counter-weights are shown more clearly in FIG. 4. It will be seen that the resulting forces F31, F32, F33, F34 are directed directly oppositely to the directions of the respective cranks.

FIGS. 5 and 6 indicate the forces F8, F9, F51, F52 to be produced by appropriate counter-weights necessary for effecting the secondary balancing. Four counter-weights are placed on the crank-shaft 1 to produce the forces F51 and F52. In order to obtain a balancing of the moments around the vertical central axis 100 of the drive mechanism it is necessary to have at least the two opposed counter-weights 8 and 9 axially spaced along on the third shaft 7. The relative angular positions of the counter-weights used for the secondary balancing are shown in FIG. 6.

Distributing the secondary counterweights between shafts 1 and 7 to achieve vector forces F51, F52, F8 and F9 as shown in FIGS. 5 and 6 results in no net moment about an axis (not shown) perpendicular to vertical axis 100 due to the added secondary counterweights.

During the first 180° of rotation of the crankshafts 1 and 2 pictured in FIG. 3, it can be seen that first forces F31 and F34 and then forces F32 and F33 produce a net counter-clockwise moment (viewed from the top) about a vertical engine axis. It can also be seen from FIG. 5 that the forces F51, F52, F8 and F9 produced by the secondary counterweights produce a net clockwise moment about axis 100 during this half-cycle, and that this moment opposes the moment produced by the primary weights. During the second 180° portion of the engine cycle the net moments due to both the primary and secondary counterweights are reversed in direction but still oppose each other.

It will be understood that the third shaft 7 could be mounted at any level relative to the two crank shafts 1 and 2. Also the counter-weights for the secondary balancing could be distributed between the shafts 2 and 7 or between all three shafts 1 and 2 and 7, and in the practical embodiment shown in FIGS. 1 and 2 such distribution is used. Furthermore the counter-weights for the primary and secondary balancing have been added as vectors at the crank-shafts 1 and 2, permitting less massive counter-weights, better mechanical efficiency, and less volume of the crank case 3, than would be necessary with some known balancing expedients.

From the above description it will be appreciated that the illustrated engine is of the kind defined, and that for balancing purposes the engine is provided with a third shaft 7 which is parallel to the two crank-shafts 1, 2, gearing 4, 5, 6 for driving the third shaft 7 in rotation in synchronism with and in the opposite direction from the two crank-shafts 1, 2, and carried by the third shaft 7 there are at least two counter-weights 8, 9 which are spaced from one another in the axial direction of the third shaft 7 and produce forces F8, F9 in directions which are diametrically opposite to one another with respect to the axis of the third shaft 7.

As shown the third shaft 7 is equi-spaced from the two crank-shafts 1, 2, and the distance of the third shaft 7 from each of the cylinders is less than the smallest distance between each of the cylinders and the axes of the two crank-shafts 1, 2.

What we claim is:

1. A double-acting four-cylinder hot gas engine of the kind in which the cylinders are all parallel with one another and there are two synchronized crank-shafts with crankshaft axes parallel to one another, said crankshafts rotating in the same angular sense, each crankshaft being connected to two pistons reciprocating along piston axes which intersect the axes of the respective crank-shaft, the intersections being axial spaced along the respective crankshafts, characterized in that for balancing purposes the engine is provided with a third shaft which is parallel to the two crank-shafts, gearing for driving the third shaft in rotation in synchronism with and in the opposite angular direction from the two crank-shafts, and at least two secondary counter-weights carried by the third shaft, which secondary counter-weights are spaced from one another in the axial direction of the third shaft and produce forces during rotation in directions which are diametrically opposite to one another with respect to the axis of the third shaft.

2. An engine according to claim 1, wherein said gearing comprises a first gear wheel secured to the third shaft and carrying one of said counter-weights and meshing with two second gear wheels secured one to each of the two crank-shafts.

3. An engine according to claim 1 or 2, wherein the third shaft is equi-spaced from the two crankshafts.

4. An engine according to claim 3, wherein the distance between the third shaft and each of the cylinders is less than the smallest distance between each of the cylinders and the axes of the two crankshafts.

5. A double-acting four-cylinder hot gas engine of the kind in which the cylinders are parallel with one another and there are two synchronized crank-shafts with crankshaft axes parallel to one another, said crankshafts rotating in the same angular sense, each crankshaft being connected to two pistons reciprocating along piston axes which intersect the axes of the respective crank-shaft, the engine comprising:

(a) four primary counter-weights each of which is positioned on one of the crank-shafts diametrically opposite a respective crank, said four primary counter-weights producing a net moment about a vertical engine axis which is perpendicular to the crank-shaft axes and parallel to the cylinder axes;

(b) a third shaft having an axis parallel to the two crankshafts;

(c) gear means for rotating said third shaft in synchronism with, and in the opposite angular direction from, the two crank-shafts; and (d) at least two secondary counter-weights spaced from one another in the axial and angular directions on said third shaft, said secondary counter-weights producing resultant forces during rotation in directions diametrically opposite to one another with respect to the axis of said third shaft, and in a direction to oppose said net moment produced by said primary counter-weights.

6. The engine as in claim 5 wherein each of said four primary counter-weights is sized for balancing the total vertical force of the respective piston.

7. The engine according to claim 5 wherein the cranks on each crank-shaft are angularly spaced 90° apart and wherein each of the cranks on one of the crank-shafts extends in the diametrically opposite direction from a corresponding one of the cranks on the other crank-shaft.

* * * * *